US009126382B2

(12) United States Patent
Krueger et al.

(10) Patent No.: US 9,126,382 B2
(45) Date of Patent: Sep. 8, 2015

(54) DEVICE FOR TRANSFERRING FOLDING BOXES

(71) Applicant: UHLMANN PAC-SYSTEME GMBH & CO. KG, Laupheim (DE)

(72) Inventors: Andreas Krueger, Donaurieden (DE); Roberto Linke, Neu-Ulm (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 462 days.

(21) Appl. No.: 13/689,096

(22) Filed: Nov. 29, 2012

(65) Prior Publication Data

US 2013/0161892 A1 Jun. 27, 2013

(30) Foreign Application Priority Data

Dec. 22, 2011 (EP) ..... 11195126

(51) Int. Cl.

| | |
|---|---|
| ***B31B 5/80*** | (2006.01) |
| ***B65H 3/08*** | (2006.01) |
| ***B65H 3/42*** | (2006.01) |
| ***B65H 5/12*** | (2006.01) |
| ***B65H 5/14*** | (2006.01) |

(52) U.S. Cl.

CPC *B31B 5/80* (2013.01); *B65H 3/085* (2013.01); *B65H 3/0808* (2013.01); *B65H 3/0883* (2013.01); *B65H 3/42* (2013.01); *B65H 5/12* (2013.01); *B65H 5/14* (2013.01); *B31B 2201/289* (2013.01); *B31B 2203/003* (2013.01); *B65H 2406/341* (2013.01); *B65H 2406/344* (2013.01)

(58) Field of Classification Search

CPC .... B65H 3/0808; B65H 3/0816; B65H 3/085; B65H 3/0883; B65H 3/42; B65H 5/12; B65H 5/14; B65H 2406/341; B65H 2406/344; B31B 5/80; B31B 2203/003; B31B 2201/289

See application file for complete search history.

(56) References Cited

U.S. PATENT DOCUMENTS

| | | | | |
|---|---|---|---|---|
| 4,194,442 | A * | 3/1980 | Martelli | 271/95 |
| 4,518,301 | A | 5/1985 | Greenwell | |
| 5,102,385 | A * | 4/1992 | Calvert | 493/315 |
| 5,662,577 | A * | 9/1997 | Reuteler | 493/315 |
| 5,700,004 | A * | 12/1997 | Bahr et al. | 271/171 |
| 5,715,657 | A * | 2/1998 | Mondani et al. | 493/316 |
| 6,101,787 | A * | 8/2000 | Brintazzoli et al. | 271/11 |
| 7,695,421 | B2 * | 4/2010 | Ford | 271/100 |
| 2009/0194930 | A1 * | 8/2009 | Stauber | 271/4.09 |
| 2010/0171258 | A1 * | 7/2010 | Schneider | 271/12 |

FOREIGN PATENT DOCUMENTS

| | | |
|---|---|---|
| DE | 4029520 | 3/1992 |
| DE | 102006045478 | 4/2008 |

OTHER PUBLICATIONS

EP Search Report for EP 11195126 dated May 21, 2012.

* cited by examiner

*Primary Examiner* — Jeremy R Severson

(74) *Attorney, Agent, or Firm* — Brinks Gilson & Lione

(57) ABSTRACT

The device for transferring folding boxes has a planetary carrier, which rotates around a horizontal axis and which includes, as its planets, two suction arms, which are supported rotatably in the planetary carrier and are connected to two roller star units, which are guided on a cam disk unit consisting of two cam disks with different curved guide surfaces. A drive for the cam disk unit is designed to turn the cam disk unit around the horizontal axis in rotational direction of the planetary carrier but at a rotational speed double the rotational speed of the planetary carrier.

15 Claims, 12 Drawing Sheets

DEVICE FOR TRANSFERRING FOLDING BOXES

RELATED APPLICATIONS

The present patent document claims the benefit of priority to European Patent Application No. EP 11195126.5, filed Dec. 22, 2011, the entire contents of each of which are incorporated herein by reference.

FIELD AND BACKGROUND OF THE INVENTION

The present invention relates to a device for transferring folding boxes.

Devices of this type are used to remove folding box blanks from a magazine and to place them in the receptacles of a suitable transport means such as a conveyor chain as the flat folding box blanks are being opened to form the folding boxes. The folding boxes can then be filled with the desired product.

An example of a device of this type for transferring folding boxes is known from U.S. Pat. No. 4,518,301. The suction elements responsible for transport are attached to suction arms, which in turn are supported rotatably in a planetary carrier, which rotates around a horizontal center axis. Each suction arm is connected to a roller star unit. These roller star units travel around the inside circumference of a cam disk and thus, during the rotation of the planetary carrier around the horizontal axis, bring about additionally an asynchronous relative rotation of the suction arms around their bearing axes, which travel along with the planetary carrier. In this way, the suction elements describe a hypocycloid path, which is suitable for transferring and setting up the folding boxes.

SUMMARY OF THE INVENTION

It is an object of the present invention to provide a device for transferring folding boxes which occupies only a small amount of space but which achieves an especially high output.

According to an aspect of the invention, the device for transferring folding boxes comprises a planetary carrier, which is driven in rotation in a predetermined rotational direction and at a predetermined rotational speed around a first stationary horizontal axis. The planetary carrier comprises a first suction arm and a second suction arm as its planets, each of these suction arms comprising at least one suction element, wherein the first suction arm is supported in the planetary carrier with freedom to rotate around a non-stationary second horizontal axis, and wherein the second suction arm is supported in the planetary carrier with freedom to rotate around a non-stationary third horizontal axis. The device also comprises two roller star units, wherein the first roller star unit is arranged in the area of the second horizontal axis and is connected to the first suction arm, and wherein the second roller star unit is arranged in the area of the third horizontal axis and is connected to the second suction arm. A cam disk unit consisting of two cooperating cam disks with different curved guide surfaces is also provided, wherein both the first roller star unit and the second roller star unit are guided along the curved guide surfaces of the two cam disks in such a way that, upon rotation of the planetary carrier around the first horizontal axis, the first suction arm follows a repeating, predetermined, irregular rotational rhythm around the non-stationary second horizontal axis, and the second suction arm follows, after a certain time delay, the same predetermined rotational rhythm around the non-stationary third horizontal axis. The curved guide surfaces of the two cam disks are arranged on the outside circumference of the disks, and a drive for the cam disk unit is provided, which is designed to rotate the cam disk unit around the first horizontal axis in the rotational direction of the planetary carrier but at a rotational speed which is double the rotational speed of the planetary carrier.

In this way, it is possible to increase the output of the device without occupying much space. In addition, it is possible in this way to place the folding boxes into the receptacles of the transport means provided for them at a relatively steep angle, which is advantageous with respect to the speed of the transfer and to the behavior of the folding boxes as they are being opened.

To guarantee that the transfer proceeds as continuously as possible, the planetary carrier extends substantially in a straight line in the radial direction on both sides of the first horizontal axis, and the two suction arms are mirror images of each other relative to the first horizontal axis.

The desired hypocycloid path is preferably obtained by providing each roller star unit with two roller stars which are connected rigidly to each other, the first roller star being guided on the first cam disk, the second roller star being guided on the second cam disk.

In a preferred embodiment, each roller star comprises three rollers. In this way it is possible for at least one roller and for a maximum of two rollers of the same roller star to be guided on the curved guide surfaces at every moment. As a result, the rotational movement of the roller star is always defined in such a way as to eliminate play.

It is advantageous here for the rollers of the first roller star to be offset from the rollers of the second roller star.

The hypocycloid path traveled by the suction elements is preferably such that, during one complete rotation of the planetary carrier, the suction elements pass through a receiving position for receiving the folding boxes, a pre-opening position for the preliminary opening of the folding boxes, and a discharge position for discharging the folding boxes, wherein the suction elements are oriented radially outward relative to the first horizontal axis in each of these three positions.

To save space, the three positions are distributed in a preferably irregular manner relative to one orbit of the planetary carrier around the first horizontal axis.

An especially preferred distribution is obtained when, between the receiving position and the pre-opening position, an angle of 80-100°, and preferably of 85-95°, is present. Also preferred is an angle between the discharge position and the receiving position of 110-130°, and preferably of 115-125°.

To eliminate the need for a second drive, the drive for the cam disk unit is preferably also connected to the planetary carrier by a mechanical transmission unit.

The mechanical transmission unit preferably comprises a plurality of gear wheels of different sizes.

For example, the cam disk unit can comprise an internal ring gear, on which at least one first gear wheel rides, which is permanently connected to a shaft, which is supported rotatably in the planetary carrier. In addition, the shaft can also be permanently connected to a second gear wheel, which is smaller than the first gear wheel and rides on a large, stationary idler gear of the device. In this way the desired gear ratio can be easily produced between the movement of the cam disk unit and the movement of the planetary carrier.

Preferably two first gear wheels and two second gear wheels are provided, wherein the two first gear wheels are opposite each other relative to the first horizontal axis, and the two second gear wheels are also opposite each other relative to the first horizontal axis. As a result the design of the overall drive has the least possible amount of play.

BRIEF DESCRIPTION OF THE DRAWINGS

Additional advantages and features of the present invention can be derived from the following description, which refers to the drawings.

DETAILED DESCRIPTION OF SPECIFIC EMBODIMENTS

Figure 1:
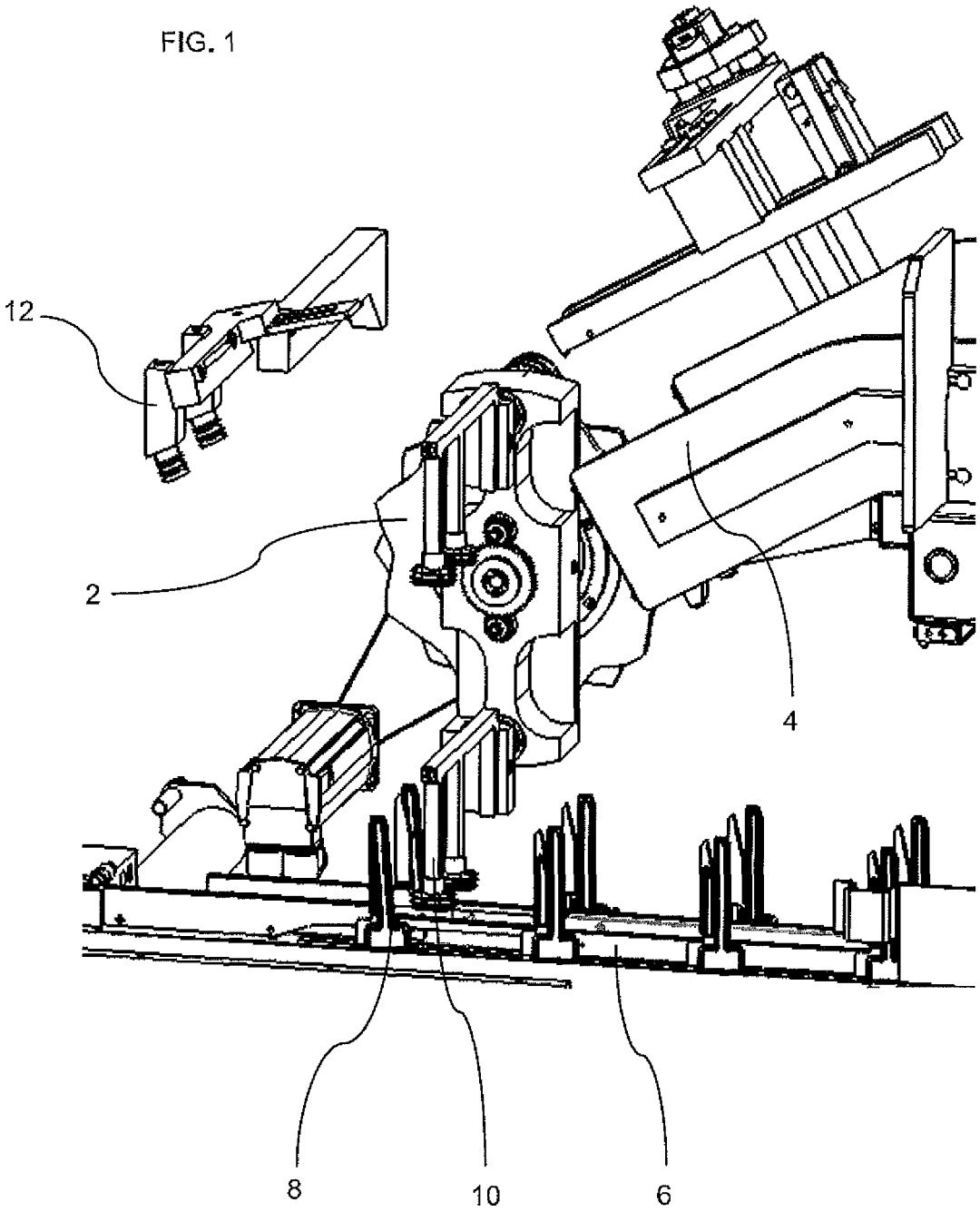
FIG. 1 is a perspective view of one embodiment of the device for transferring folding boxes according to the invention together with the machine components surrounding it.

FIG. 1 shows a preferred embodiment of a device 2 for transferring folding boxes according to the invention together with the machine components surrounding it. The device 2 serves to receive flat folding box blanks from a folding box magazine 4 and to transfer these folding box blanks to the receptacles of a transport means 6. In the example shown here, the transport means 6 is a conveyor belt, which moves either in timed steps or continuously, and the receptacles of which are formed by upward-projecting tangs 8. As the folding box blanks are being placed in the receptacles of the transport means 6, each folding box blank is also opened to form a folding box. This is accomplished by the cooperation between the tangs 8 and the suction function of the suction elements 10 of the transfer device 2. The blank-opening step can also be done on stationary opening strips in the area of the transport means 6 while the transport means 6 is being operated in a stepwise manner, or it can be done with the help of both the tangs 8 and the opening strips. Of course, many other embodiments of the transport means 6 are also conceivable. During the process of transferring the folding box blanks, it can be helpful for these to be pre-opened by an opposing suction element 12 as they travel from the folding box magazine 4 to the transport means 6. This facilitates the later complete opening of the folding box blanks in the receptacles of the transport means 6.

A preferred embodiment of the device 2 for transferring folding boxes according to the invention will now be described in detail with reference to FIGS. 2 and 3. The device 2 comprises a first suction arm 14 and a second suction arm 16, which are supported rotatably in a planetary carrier 18 and which represent the planets of the planetary carrier 18. The planetary carrier 18 is illustrated merely in longitudinal cross section in FIGS. 2 and 3, so that the details of the interior life of the drive mechanism to be described later are not obscured. In reality, the planetary carrier 18 also comprises a second half, which is identical in design to the first half shown and which cooperates with it to form a one-piece planetary carrier 18 (see FIG. 1).

The planetary carrier 18 can be driven, preferably continuously, around a first stationary horizontal axis 20 in a predetermined rotational direction (arrow A) at a predetermined rotational speed. The suction arms 14, 16 are mounted rotatably in the planetary carrier 18 by ball bearings or other known bearing mechanisms. In the example shown here, each suction arm 14, 16 comprises two suction elements 10, wherein, in certain embodiments, more than two suction elements 10 or only one suction element can be provided. All of the suction elements 10 of the same suction arm 14, 16 have suction surfaces in the same plane.

In the preferred embodiment, the suction arms 14, 16 have an angled shape, comprising a straight base section 22 in the area of the planetary carrier 18 and a gate-shaped extension 24, on the short leg 26 of which, i.e., the leg facing away from the planetary carrier 18, the outer one of the two suction elements 10 is arranged. The inner suction element 10 of each suction arm 14, 16 is arranged inside the gate-shaped extension 24 at the end of another leg 28 extending parallel to the short leg 26. Of course, there are many other possible ways in which the geometry of the suction arms 14, 16 and the arrangement of the suction elements 10 can be designed.

In the example shown, the planetary carrier 18 itself extends substantially in a straight line in the radial direction on both sides of the first horizontal axis 20, and the two suction arms 14, 16 lie opposite each other, as mirror images, relative to the first horizontal axis 20. The first suction arm 14 is supported rotatably in the planetary carrier 18 around a non-stationary second horizontal axis 30, whereas the second suction arm 16 is supported rotatably in the planetary carrier 18 around a non-stationary third horizontal axis 32. The term "non-stationary" refers to the rotational movement of the planetary carrier 18 in direction A, as a result of which the second horizontal axis 30 and the third horizontal axis 32 travel around a circular path.

At the end opposite the suction elements 10, each suction arm 14, 16 comprises a roller star unit 34, 36. The first roller star unit 34 is thus connected to the first suction arm 14 and is arranged in the area of the second horizontal axis 30, whereas the second roller star unit 36 is connected to the second suction arm 16 and is arranged in the area of the third horizontal axis 32. In the example shown, each roller star unit 34, 36 comprises exactly two roller stars 38, 40, which are permanently connected to each other. The first roller star 38 in this case comprises three rollers 42, which are distributed preferably uniformly around the circumference of the roller star. The second roller star 40 also comprises three rollers 44, which are also distributed preferably uniformly around the circumference of the second roller star 40. The rollers 42 of the first roller star 38 are offset from the rollers 44 of the second roller star 40, preferably so that the rollers 42 of the first roller star 38 are precisely half-way between the rollers 44 of the second roller star 40 and vice versa. All of the rollers 42, 44 are, of course, supported rotatably in their associated roller star 38, 40.

The device 2 also comprises a cam disk unit 46 consisting of two cooperating cam disks 48, 50 with different curved guide surfaces 52, 54. The cam disks 48, 50 are preferably permanently connected to each other. The cam disks 48, 50 comprise relatively large elevations and depressions, which are asymmetric in design, as a result of which the asymmetric curved guide surfaces 52, 54 are formed for the roller star units 34, 36. Accordingly, the curved guide surfaces 52, 54 of the two cam disks 48, 50 are arranged on their outer periphery. As the roller stars travel around, the first roller star 38 of each suction arm 14, 16 is guided on the first cam disk 48, and the second roller star 40 of each suction arm 14, 16 is guided on the second cam disk 50.

Overall, both the first roller star unit 34 and the second roller star unit 36 are guided along the curved guide surfaces 52, 54 of the two cam disks 48, 50 in such a way that, on rotation of the planetary carrier 18 around the first horizontal axis 20, the first suction arm 14 follows a repeating, predetermined, irregular rotational rhythm around the non-stationary second horizontal axis 30, and the second suction arm 16, after a certain time delay, follows the same predetermined rotational rhythm around the non-stationary third horizontal axis 32. The time delay corresponds here preferably to one half of a rotational cycle.

According to an aspect of the invention, a drive is provided for the cam disk unit 46. This drive is designed to turn the cam disk unit 46 around the first horizontal axis 20 in the rotational direction A of the planetary carrier 18 but at a rotational speed which is double the rotational speed of the planetary carrier 18. In the embodiment shown, the drive comprises a servo motor 58 and a corresponding drive belt 60, which transmits the motor power to the cam disk unit 46. The person skilled in the art, however, will be able to conceive of a wide variety of modifications.

In the preferred embodiment, the drive for the cam disk unit 46 is also connected to the planetary carrier 18 by a mechanical transmission unit, which comprises a plurality of gear wheels of different sizes, and thus also drives the planetary carrier 18. In this way it is possible to eliminate the need for a separate drive for the planetary carrier 18, which reduces the overall cost. Of course, an independent drive could also be provided for the planetary carrier 18.

In the concrete embodiment shown here, the cam disk unit 46 comprises an internal ring gear 62, on which two first gear wheels 64 ride, each of which being permanently connected to a shaft 66, which is supported in the planetary carrier 18 with freedom to rotate around a horizontal axis. On the end of the shaft 66 facing away from the first gear wheel 64, i.e., the end which projects out from the opposite side of the planetary carrier 18, the shaft 66 is also permanently connected to a second gear wheel 68, which is smaller than the first gear wheel 64 and which travels around a large, stationary idler gear wheel 70 of the device and thus around the first horizontal axis 20.

Using two first gear wheels 64 and two second gear wheels 68 ensures that the planetary carrier 18 will operate with an especially small degree of play, especially when the two first gear wheels 64 are directly opposite each other relative to the first horizontal axis 20 and the two second gear wheels 68 are directly opposite each other relative to the first horizontal axis 20. It could also be sufficient, however, to provide only one first gear wheel 64 and one second gear wheel 68. The person skilled in the art, furthermore, will be able to conceive of a whole series of alternative possibilities for the mechanical transmission unit installed between the cam disk unit 46 and the planetary carrier 18. The important point in every case, however, is that, through the use of a suitable gear ratio, the planetary carrier 18 must rotate in the same direction A as the cam disk unit 46 but at only half its speed. In other words, this means that, with respect to its rotational movement, the planetary carrier 18 is overtaken at regular intervals by the cam disk unit 46.

Figure 2:
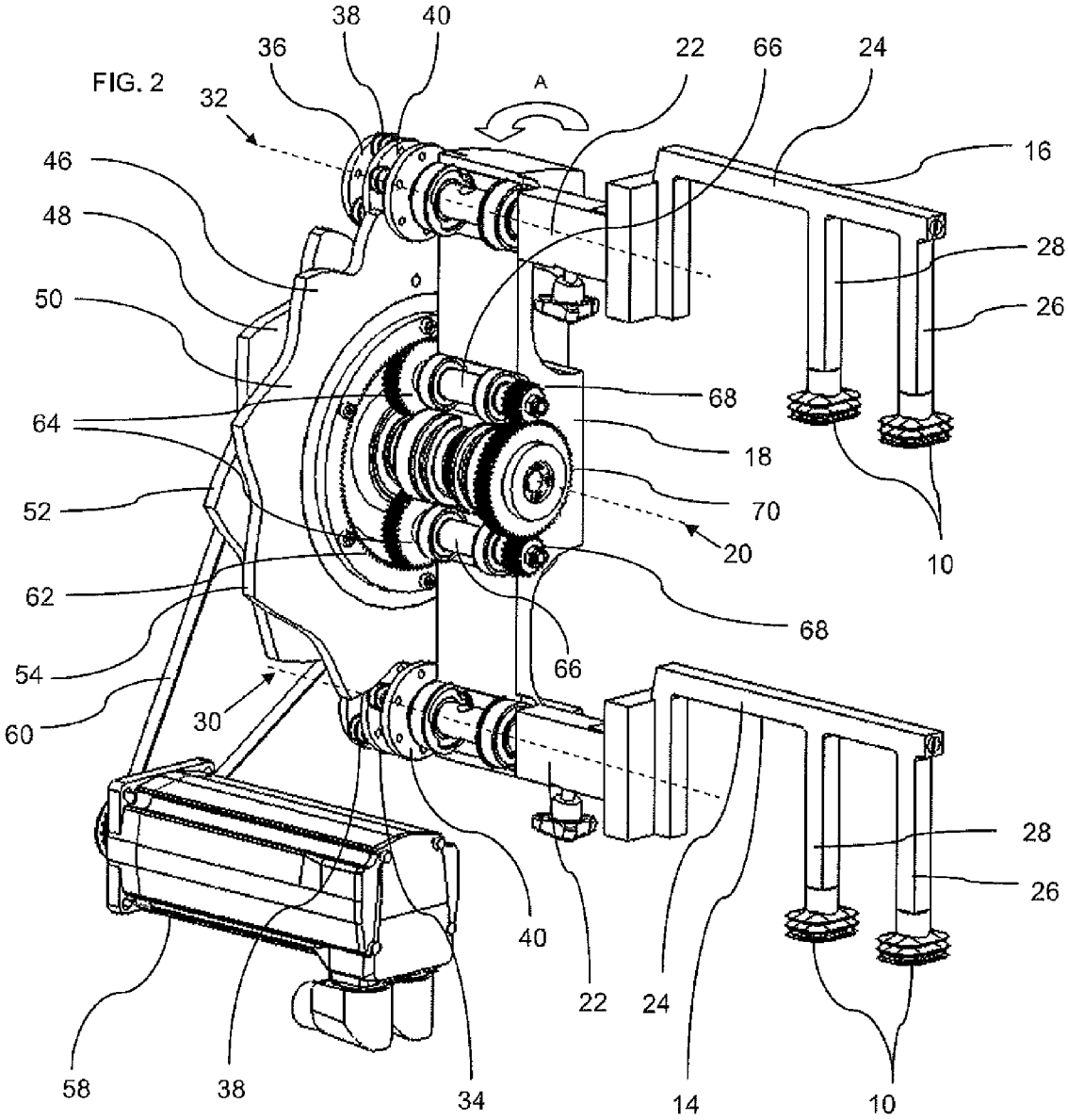
FIG. 2 is a perspective view of the device for transferring folding boxes of FIG. 1, seen at an angle from the front.
Figure 3:
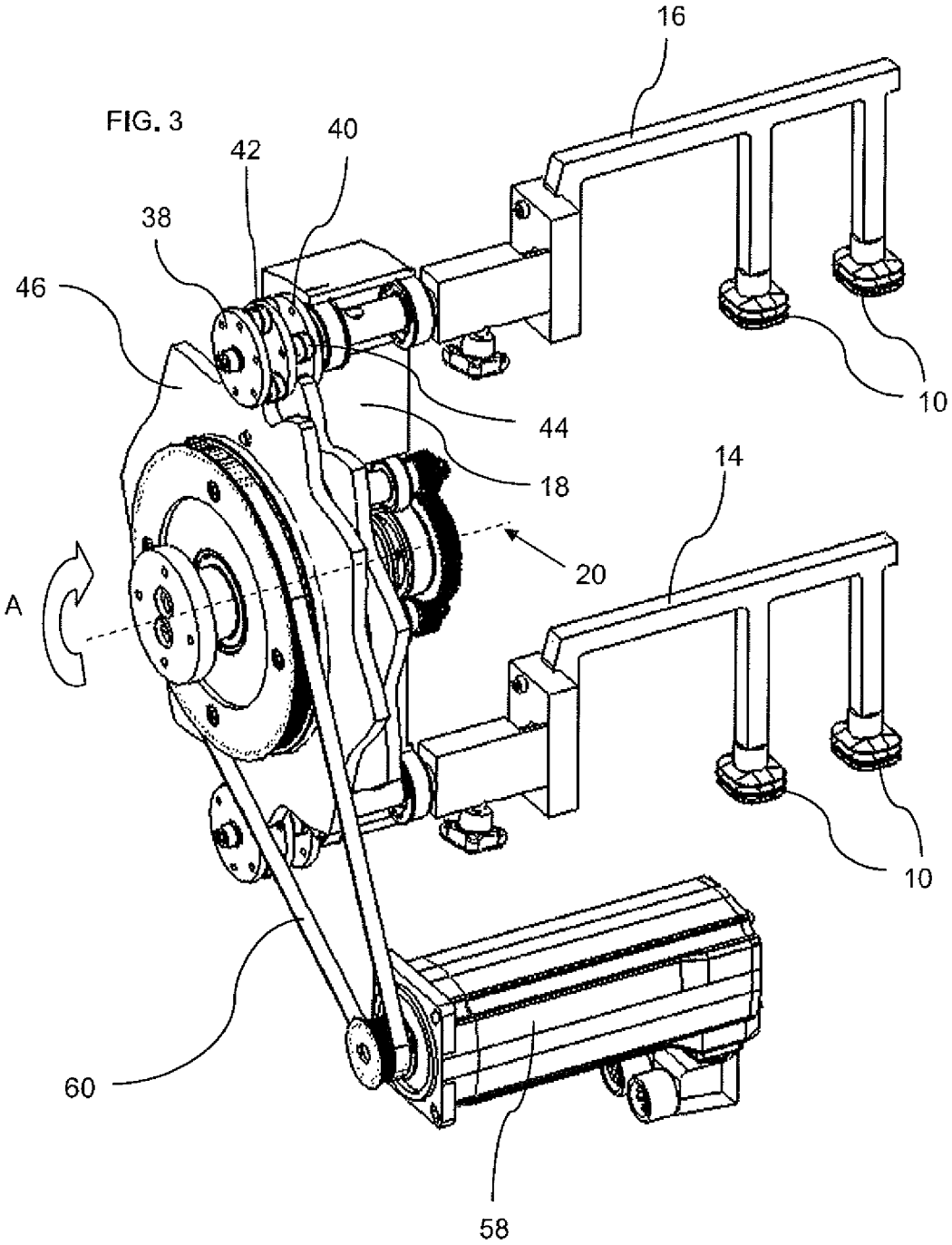
FIG. 3 is a perspective view of the device for transferring folding boxes of FIG. 1, seen at an angle from the rear.
Figure 4:
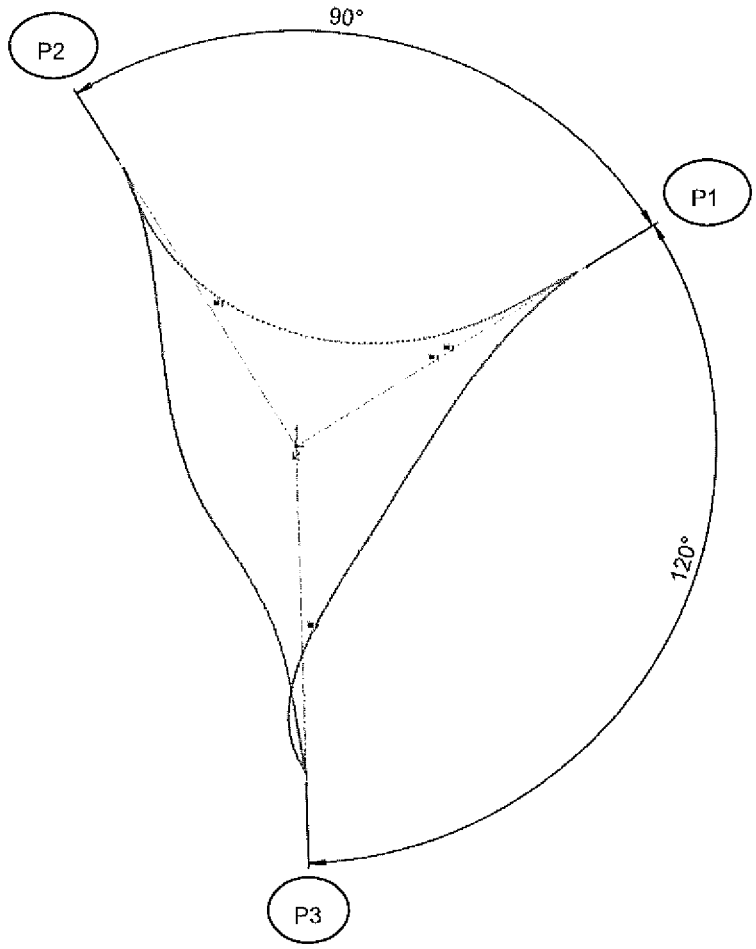
FIG. 4 is a diagram of the hypocycloid path along which each suction element travels in the embodiment of the device for transferring folding boxes according to FIGS. 2 and 3.

FIG. 4 shows the hypocycloid path of the individual suction elements 10 achieved with the embodiment of the device 2 for transferring folding boxes according to FIGS. 2 and 3. Over the course of one full rotation of the planetary carrier 18, each suction element 10 therefore passes through, first, a receiving position P1 for receiving the folding box blanks, then a pre-opening position P2 for the preliminary opening of the folding box blanks, and finally a discharge position P3 for discharging the folding boxes onto the transport means 6. In each of these three positions P1, P2, P3, the suction elements 10 are directed radially outward relative to the first horizontal axis 20.

As shown in FIG. 1, the folding box magazine 4 is arranged at the receiving position P1 of the suction element 10, the opposing suction element 12 is located at the pre-opening position P2 of the suction element 10, and the associated receiving receptacle of the transport means 6 is located at the discharge position P3 of the suction element 10. As can be derived from FIG. 4, the three positions P1, P2, P3 are distributed irregularly around the first horizontal axis 20 relative to one rotation. An angle of 80-100°, preferably of 85-95°, and even more preferably of 90°, is present between the receiving position P1 and the pre-opening position P2. An angle of 110-130°, preferably of 115-125°, even more preferably of 120°, is desirable between the discharge position P3 and the receiving position P1. In this way it is possible, without taking up much space, to ensure that the folding box blanks are introduced into the transport means 6 at a steep angle and simultaneously that the folding boxes will be opened and set up properly at high throughput.

Figure 5:
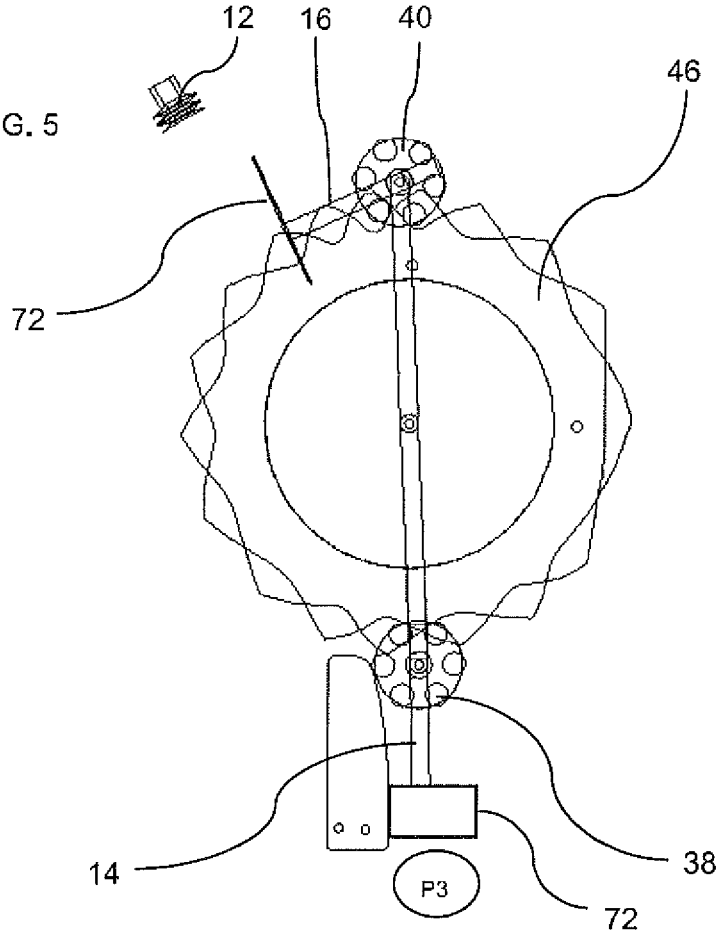
FIGS. 5-19 are schematic front views of the device for transferring folding boxes according to FIGS. 2 and 3, which illustrate the successive stages of a complete rotational cycle of the planetary carrier.
Figure 6:
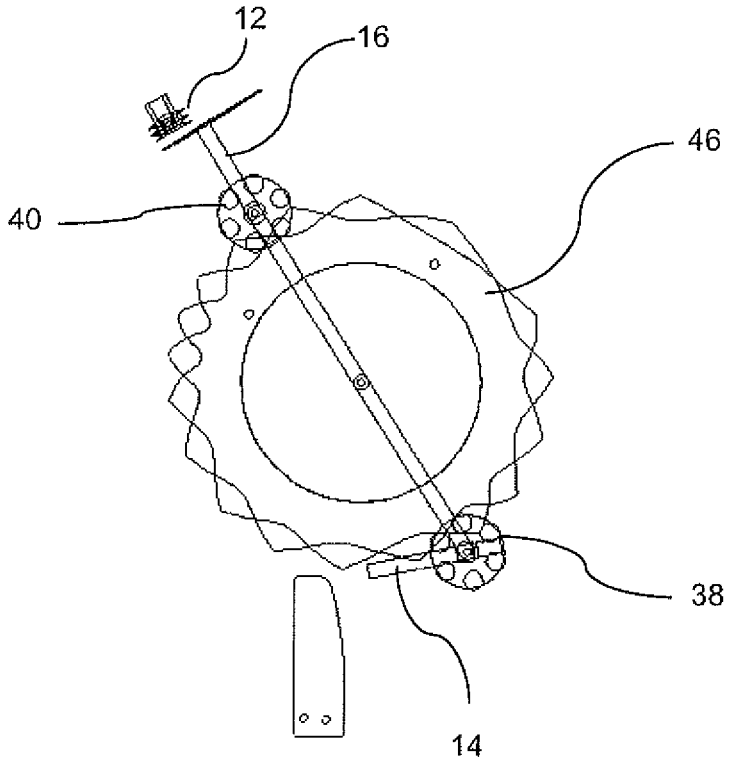
Figure 7:
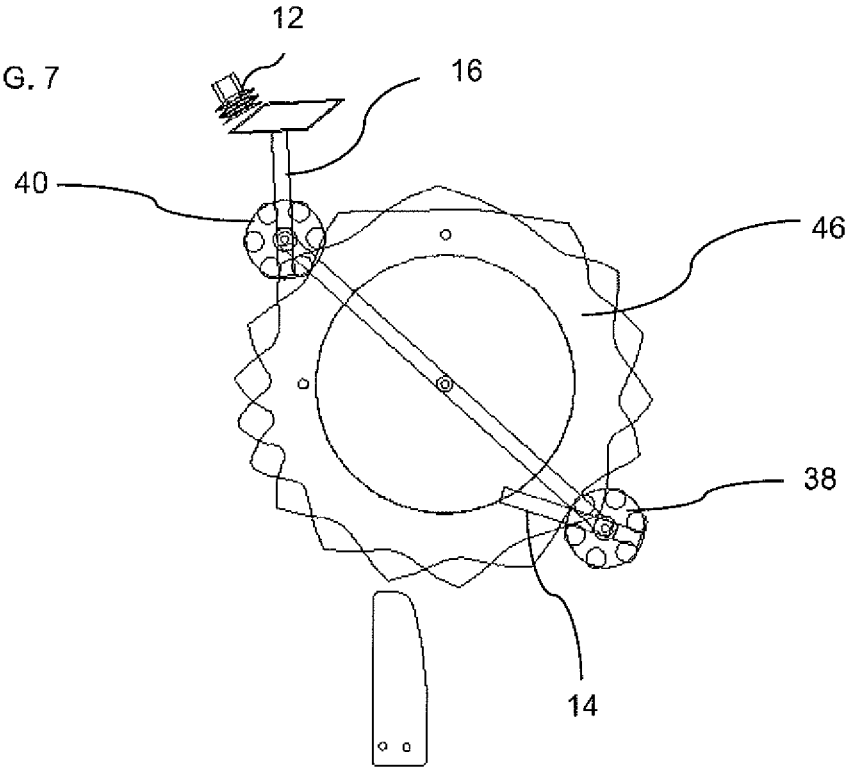
Figure 8:
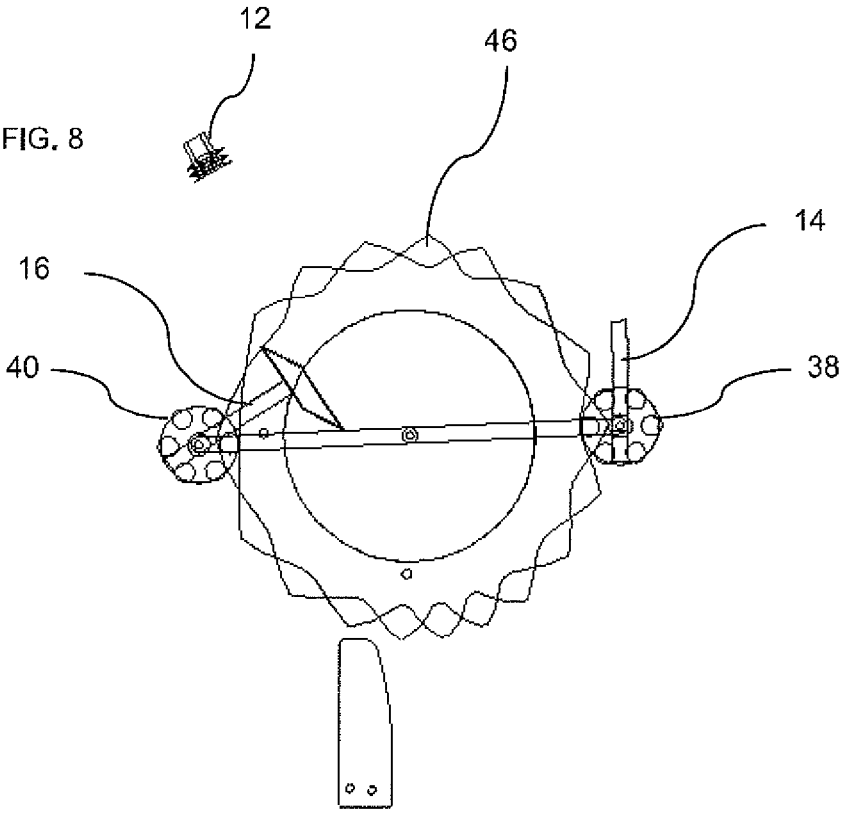
Figure 9:
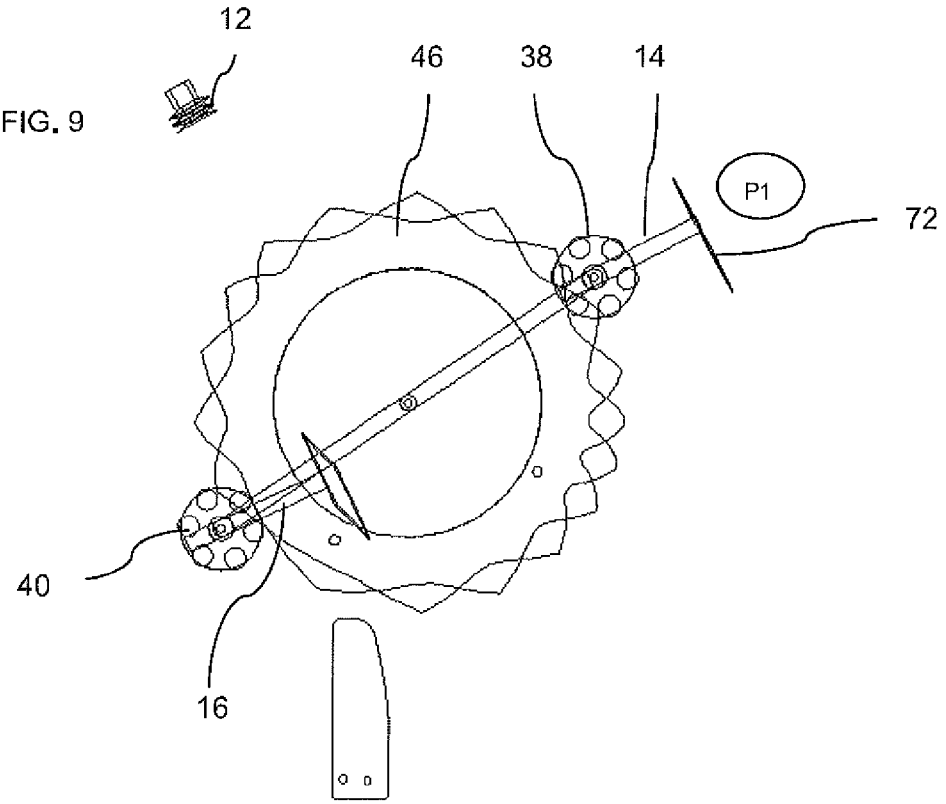
Figure 10:
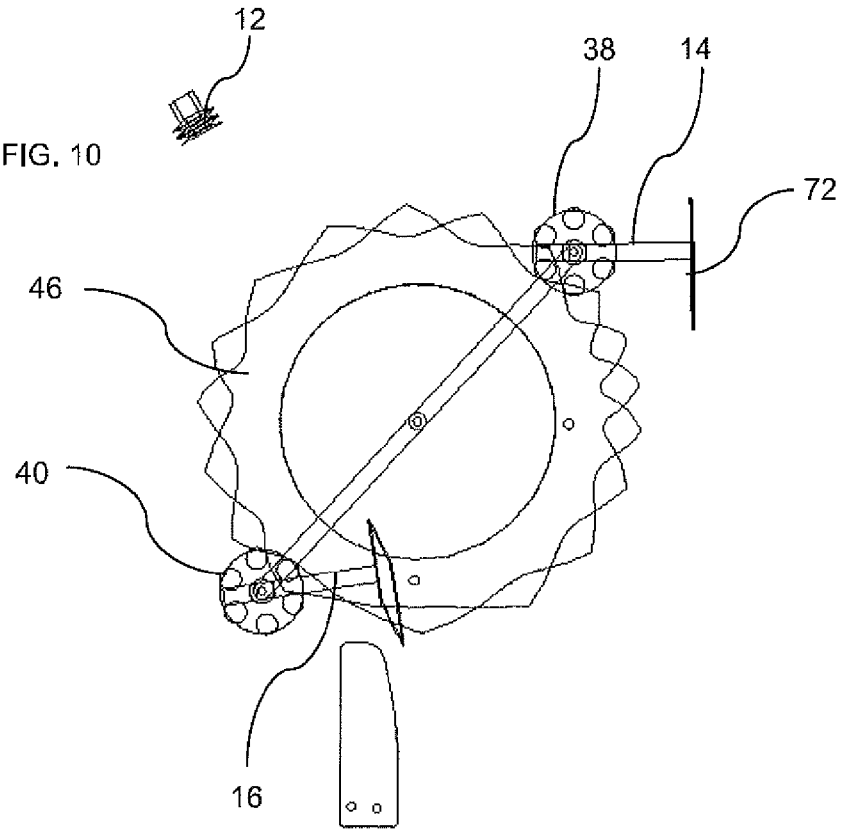
Figure 11:
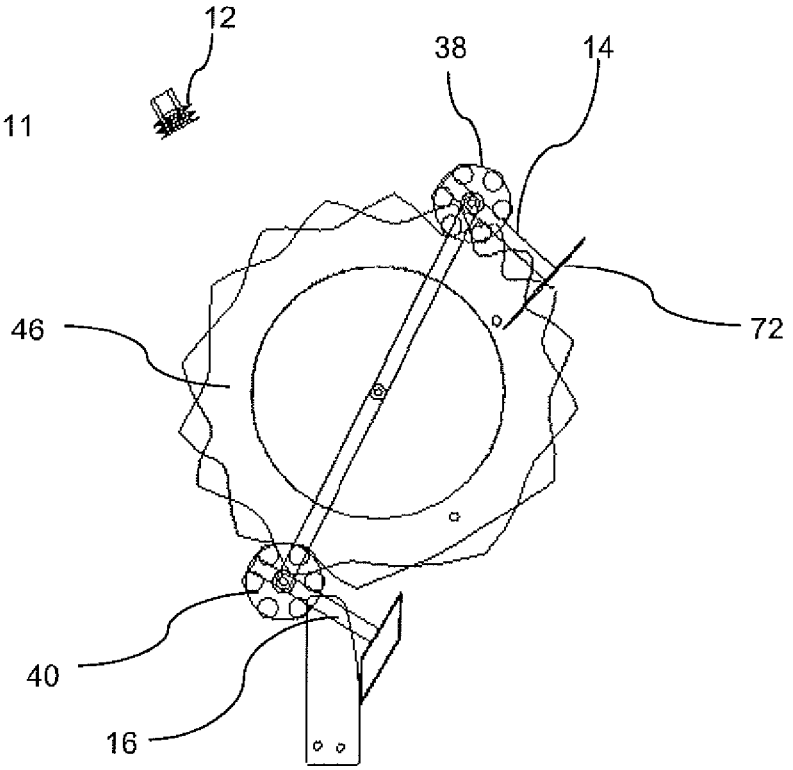
Figure 12:
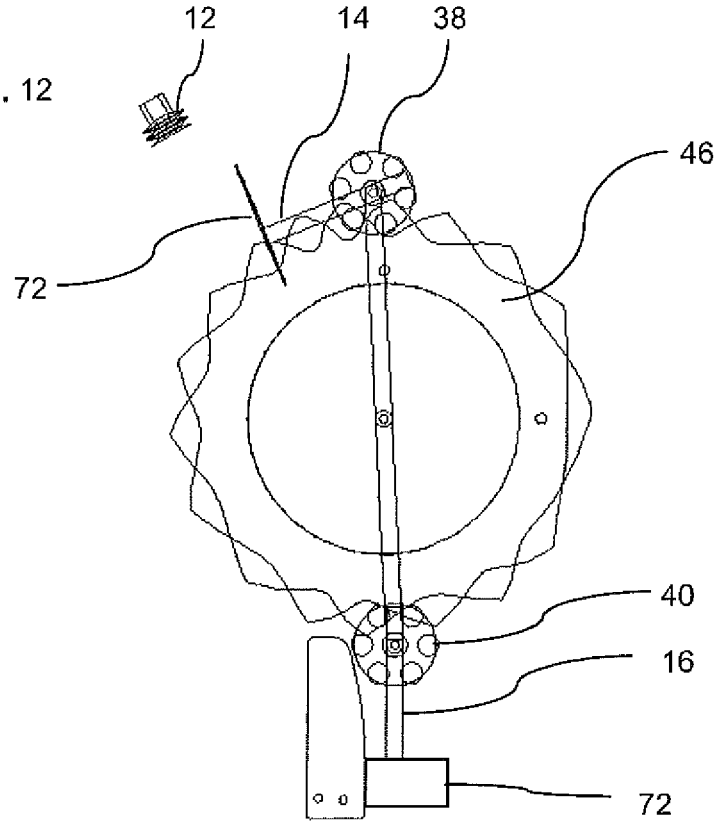
Figure 13:
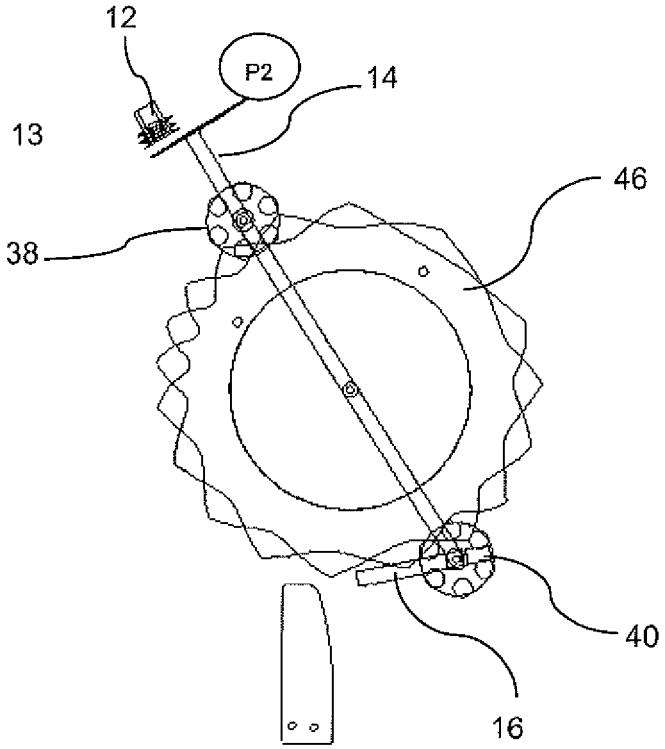
Figure 14:
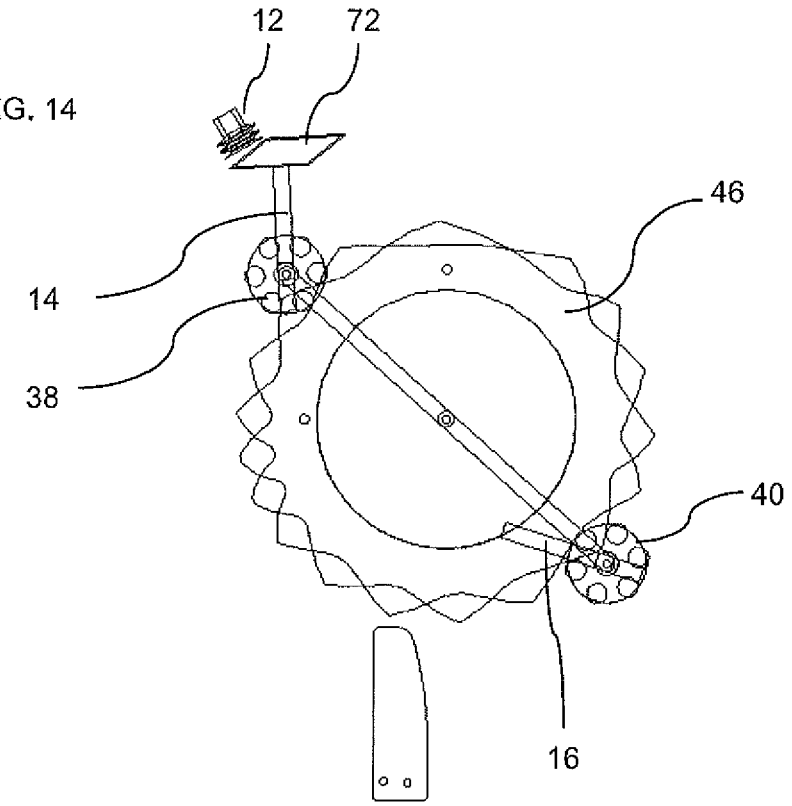
Figure 15:
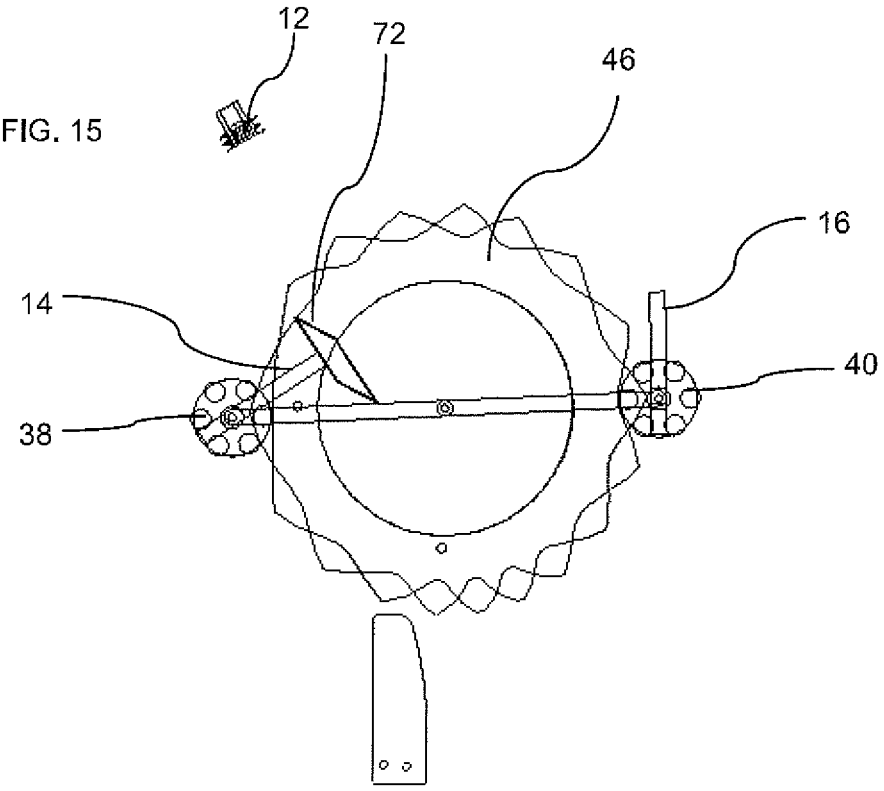
Figure 16:
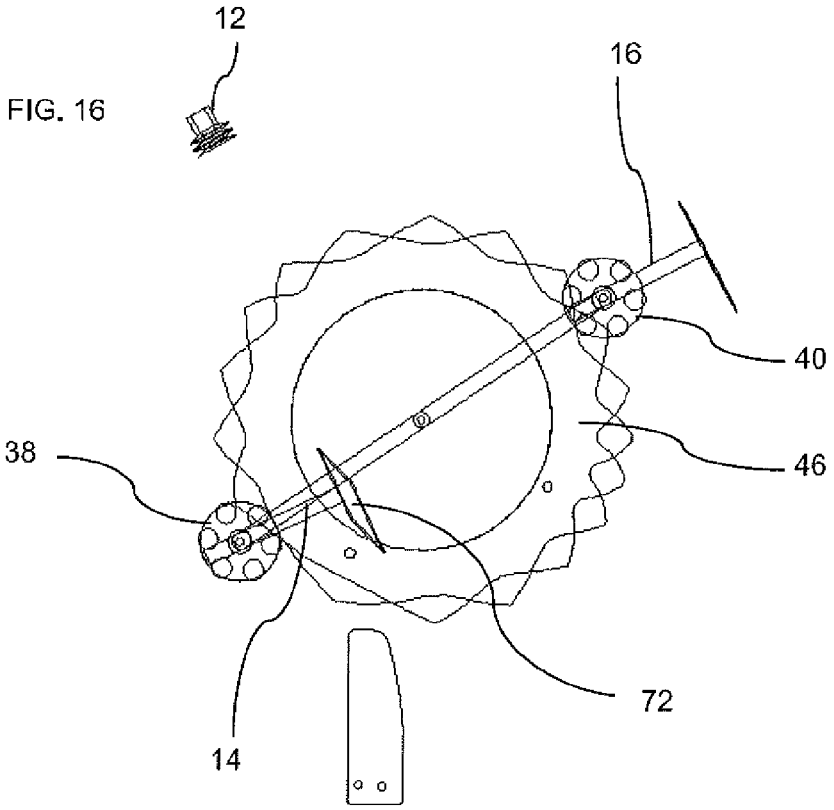
Figure 17:
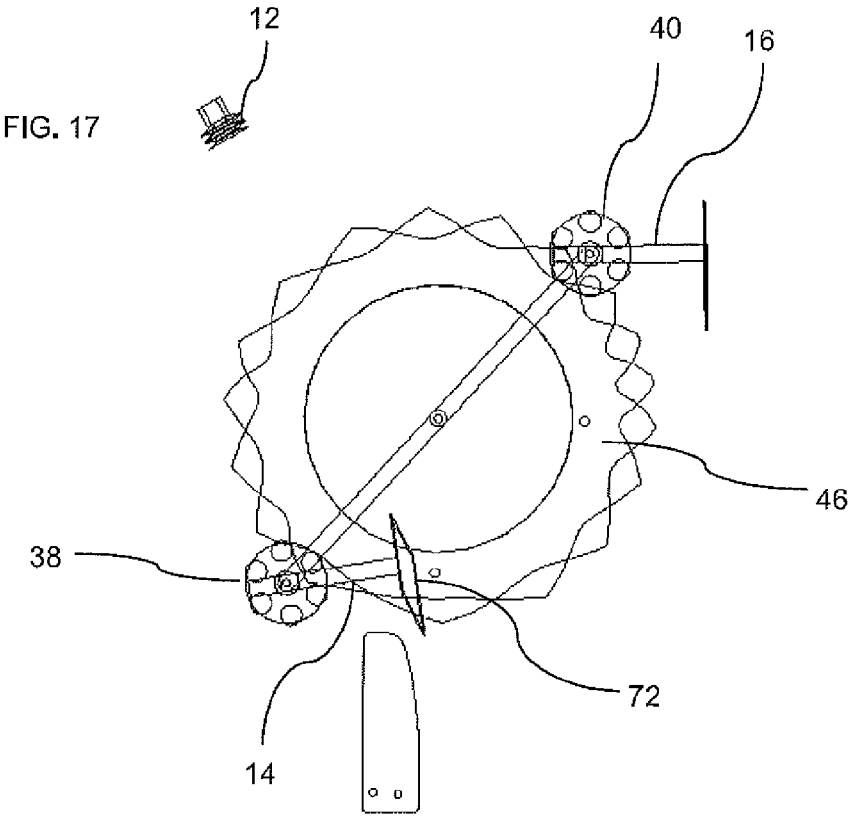
Figure 18:
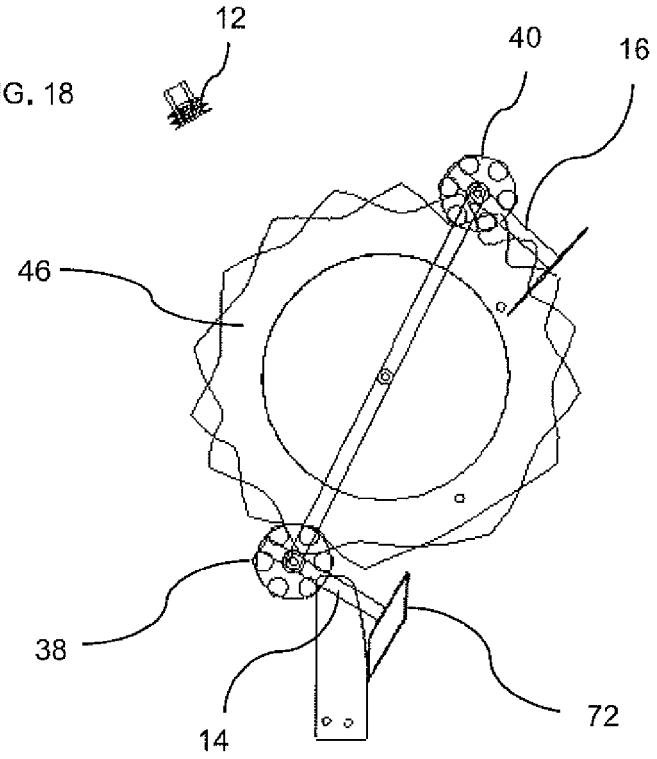
Figure 19:
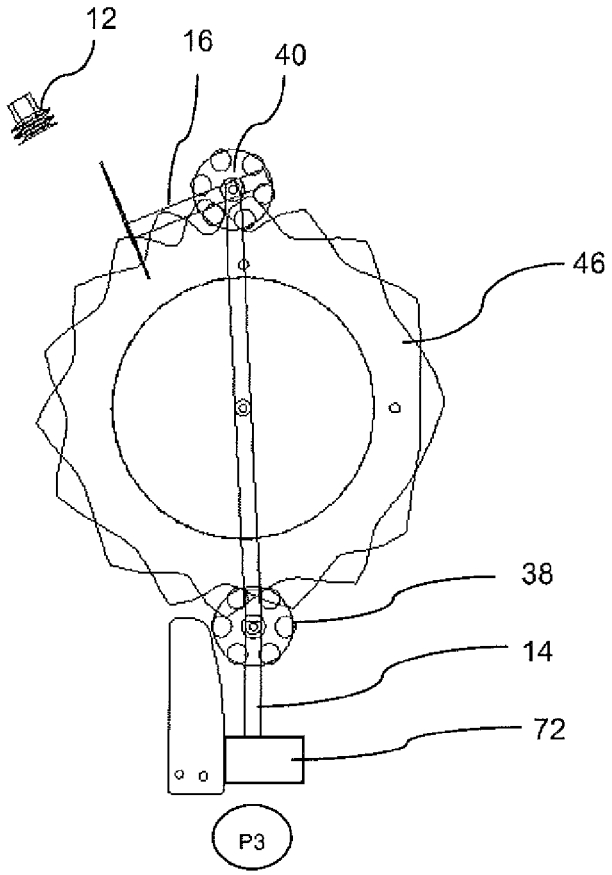

FIGS. 5-19 show in schematic fashion the positions of the suction arms 14, 16 and of the captured folding box blanks 72 for one complete orbit of the planetary carrier 18. In FIG. 5, the first suction arm 14 is located in the discharge position P3; according to FIGS. 6-8 it is then raised until it arrives in the receiving position P1 in FIG. 9. There it takes up the folding box blank 72 and, as shown in FIGS. 10-12, is carried onward toward the pre-opening position P2. In FIG. 13, it has arrived in the pre-opening position P2. According to FIGS. 14-18, it is then carried onward until, in FIG. 19, it has arrived back again in the discharge position P3.

Because the patterns of the movements of the two suction arms 14, 16 are the same, there is no need to describe in detail the positions of the second suction arm 16 during its rotation. The various positions of the second suction arm 16 can be derived from FIGS. 5-19.

In the example shown here, the invention was described on the basis of two suction arms 14, 16. It is also possible to use a different, even number of suction arms, such as four suction arms. The hypocycloid path shown can also be adapted as appropriate by changing the geometry of the cam disk unit 46 and of the roller star units 34, 36.

The invention claimed is:

1. A device for transferring folding boxes comprising:

a planetary carrier, which is driven in a predetermined rotational direction at a predetermined rotational speed around a first stationary axis, and which comprises, as its planets, a first suction arm and a second suction arm, each of which comprising at least one suction element, wherein the first suction arm is supported in the planetary carrier with freedom to rotate around a non-stationary second horizontal axis, and wherein the second suction arm is supported in the planetary carrier with freedom to rotate around a non-stationary third horizontal axis;

two roller star units, wherein the first roller star unit is arranged in an area of the second horizontal axis and is connected to the first suction arm, and wherein the second roller star unit is arranged in an area of the third horizontal axis and is connected to the second suction arm; and a cam disk unit comprising first and second cam disks having different curved guide surfaces arranged on an outside periphery of the cam disks, wherein both the first roller star unit and the second roller star unit are arranged to be guided along the curved guide surfaces of the two cam disks in such a way that, upon rotation of the planetary carrier around the first horizontal axis, the first suction arm follows a repeating, predetermined, irregular rotational rhythm around the non-stationary second horizontal axis, and, after a certain time delay, the second suction arm follows the same predetermined rotational rhythm around the non-stationary third horizontal axis;

wherein a drive for the cam disk unit is provided, which is designed to turn the cam disk unit around the first horizontal axis in the rotational direction of the planetary carrier but at a rotational speed which is double the rotational speed of the planetary carrier.

2. The device of claim 1, wherein the planetary carrier extends substantially in a straight line in a radial direction on both sides of the first horizontal axis, and wherein the two suction arms are opposite each other as mirror images relative to the first horizontal axis.

3. The device of claim 1, wherein each roller star unit comprises first and second roller stars connected permanently to each other, the first roller star being guided on the first cam disk, the second roller star being guided on the second cam disk.

4. The device of claim 3, wherein each roller star comprises three rollers.

5. The device of claim 4, wherein the rollers of the first roller star are offset from the rollers of the second roller star.

6. The device of claim 1, wherein each suction element travels along a hypocycloid path during one full rotation of the planetary carrier around the first horizontal axis.

7. The device of claim 6, wherein, during one full rotation of the planetary carrier, each suction element passes through a receiving position for receiving the folding boxes, a pre-opening position for a preliminary opening of the folding boxes, and a discharge position for discharging the folding boxes, wherein each suction element is directed radially outward relative to the first horizontal axis in each of the receiving position, the pre-opening position, and the discharge position.

8. The device of claim 7, wherein the receiving position, the pre-opening position, and the discharge position are distributed irregularly with respect to one orbit around the first horizontal axis.

9. The device of claim 8, wherein an angle between the receiving position and the pre-opening position is between 80° and 100°.

10. The device of claim 9, wherein an angle between the discharge position and the receiving position is between 110° and 130°.

11. The device according to claim 1, wherein the drive for the cam disk unit is also connected to the planetary carrier by a mechanical transmission unit and thus drives the planetary carrier.

12. The device of claim 11, wherein the mechanical transmission unit comprises a plurality of gear wheels of different sizes.

13. The device of claim 12, wherein the cam disk unit comprises an internal ring gear, on which at least one first gear wheel rides, which is permanently connected to a shaft, which is rotatably supported in the planetary carrier.

14. The device of claim 13, wherein the shaft is also permanently connected to a second gear wheel, which is smaller than the first gear wheel and rides on a large stationary idler gear of the device.

15. The device of claim 14, wherein two first gear wheels and two second gear wheels are provided, wherein the two first gear wheels are opposite each other relative to the first horizontal axis, and wherein the two second gear wheels are also opposite each other relative to the first horizontal axis.

* * * * *